US009751314B2

(12) United States Patent
Ueda

(10) Patent No.: US 9,751,314 B2
(45) Date of Patent: Sep. 5, 2017

(54) LIQUID EJECTING APPARATUS

(71) Applicant: Brother Kogyo Kabushiki Kaisha, Nagoya-shi, Aichi-ken (JP)

(72) Inventor: Toshiro Ueda, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/086,235

(22) Filed: Mar. 31, 2016

(65) Prior Publication Data

US 2017/0028729 A1 Feb. 2, 2017

(30) Foreign Application Priority Data

Jul. 31, 2015 (JP) ..... 2015-152877

(51) Int. Cl.

| | |
|---|---|
| ***B41J 2/175*** | (2006.01) |
| ***B41J 29/38*** | (2006.01) |
| ***B41J 29/393*** | (2006.01) |
| *B41J 2/165* | (2006.01) |
| *B41J 2/19* | (2006.01) |
| *B41J 2/18* | (2006.01) |

(52) U.S. Cl.

CPC ..... *B41J 2/175* (2013.01); *B41J 2/17509* (2013.01); *B41J 29/38* (2013.01); *B41J 29/393* (2013.01); *B41J 2/1652* (2013.01); *B41J 2/16523* (2013.01); *B41J 2/16532* (2013.01); *B41J 2/17503* (2013.01); *B41J 2/18* (2013.01); *B41J 2/19* (2013.01)

(58) Field of Classification Search

None

See application file for complete search history.

(56) References Cited

U.S. PATENT DOCUMENTS 5,988,782 A 11/1999 Miura et al.
8,696,086 B2 4/2014 Nakazawa
(Continued)

FOREIGN PATENT DOCUMENTS

JP H08-276599 A 10/1996
JP 3190540 B2 7/2001
(Continued)

OTHER PUBLICATIONS

Machine Translation of JP2008006657A, Ikeda et al., Jan. 17, 2008, paragraphs 0016-0040.*

*Primary Examiner* — Lisa M Solomon

(74) *Attorney, Agent, or Firm* — Banner & Witcoff, Ltd.

(57) ABSTRACT

A discharger is configured to discharge liquid in a liquid channel to outside the liquid channel. The liquid is at least one of first liquid and second liquid different from the first liquid. An agitator is configured to agitate the liquid in the liquid channel. When executed by a processor, instructions cause the processor to perform: an introducing process of, when the second liquid exists in the liquid channel, controlling the discharger to discharge the second liquid to outside the liquid channel and to introduce the first liquid from the tank into the liquid channel; an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel.

17 Claims, 10 Drawing Sheets

(56) References Cited

U.S. PATENT DOCUMENTS

| | | | | |
|---|---|---|---|---|
| 2006/0066652 | A1* | 3/2006 | Sugahara | B41J 2/14233 347/9 |
| 2012/0075364 | A1 | 3/2012 | Nakazawa | |

FOREIGN PATENT DOCUMENTS

| | | | | |
|---|---|---|---|---|
| JP | 2002-211008 | A | | 7/2002 |
| JP | 2008006657 | A | * | 1/2008 |
| JP | 2012-091500 | A | | 5/2012 |

* cited by examiner

LIQUID EJECTING APPARATUS

CROSS REFERENCE TO RELATED APPLICATIONS

This application claims priority from Japanese Patent Application No. 2015-152877 filed Jul. 31, 2015. The entire content of the priority application is incorporated herein by reference.

TECHNICAL FIELD

This disclosure relates to a liquid ejecting apparatus.

BACKGROUND

Regarding an inkjet printer as an example of a liquid ejecting apparatus, when the inkjet printer is shipped from a factory, filling liquid (preservation liquid) different from ink is filled in a head unit including an inkjet head and an ink channel for supplying the inkjet head with ink, for the purpose of maintain functions of the inkjet head. In this inkjet printer, before performing the initial printing (before the initial use), by discharging filling liquid filled in the head unit from nozzles and by performing initial purge of introducing ink from an ink cartridge to the inkjet head, filling liquid filled in the head unit is replaced with ink.

SUMMARY

According to one aspect, this specification discloses a liquid ejecting apparatus. The liquid ejecting apparatus includes a head unit, a discharger, an agitator, a processor; and a memory storing instructions. The head unit has nozzles configured to eject first liquid and has a liquid channel in fluid communication with the nozzles. The liquid channel is configured to supply the nozzles with the first liquid stored in a tank. The discharger is configured to discharge liquid in the liquid channel to outside the liquid channel. The liquid is at least one of the first liquid and second liquid different from the first liquid. The agitator is configured to agitate the liquid in the liquid channel. When executed by the processor, the instructions cause the processor to perform: an introducing process of, when the second liquid exists in the liquid channel, controlling the discharger to discharge the second liquid to outside the liquid channel and to introduce the first liquid from the tank into the liquid channel; an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel.

BRIEF DESCRIPTION OF THE DRAWINGS

Embodiments in accordance with this disclosure will be described in detail with reference to the following figures wherein.

DETAILED DESCRIPTION

If preservation liquid remains in the head unit at the time of using the inkjet printer, ink in which preservation liquid is mixed is ejected from the head unit, which deteriorates print quality. Hence, in order to ensure print quality, preservation liquid in the head unit needs to be discharged sufficiently before performing the initial printing. However, the inventor of the present application found that there are cases that, even if the above-mentioned initial purge is simply performed before performing the initial printing, a large amount of preservation liquid remains in the head unit.

In view of the foregoing, an example of the object of this disclosure is to provide a liquid ejecting apparatus capable of reducing preservation liquid remaining in a head unit.

Figure 1:
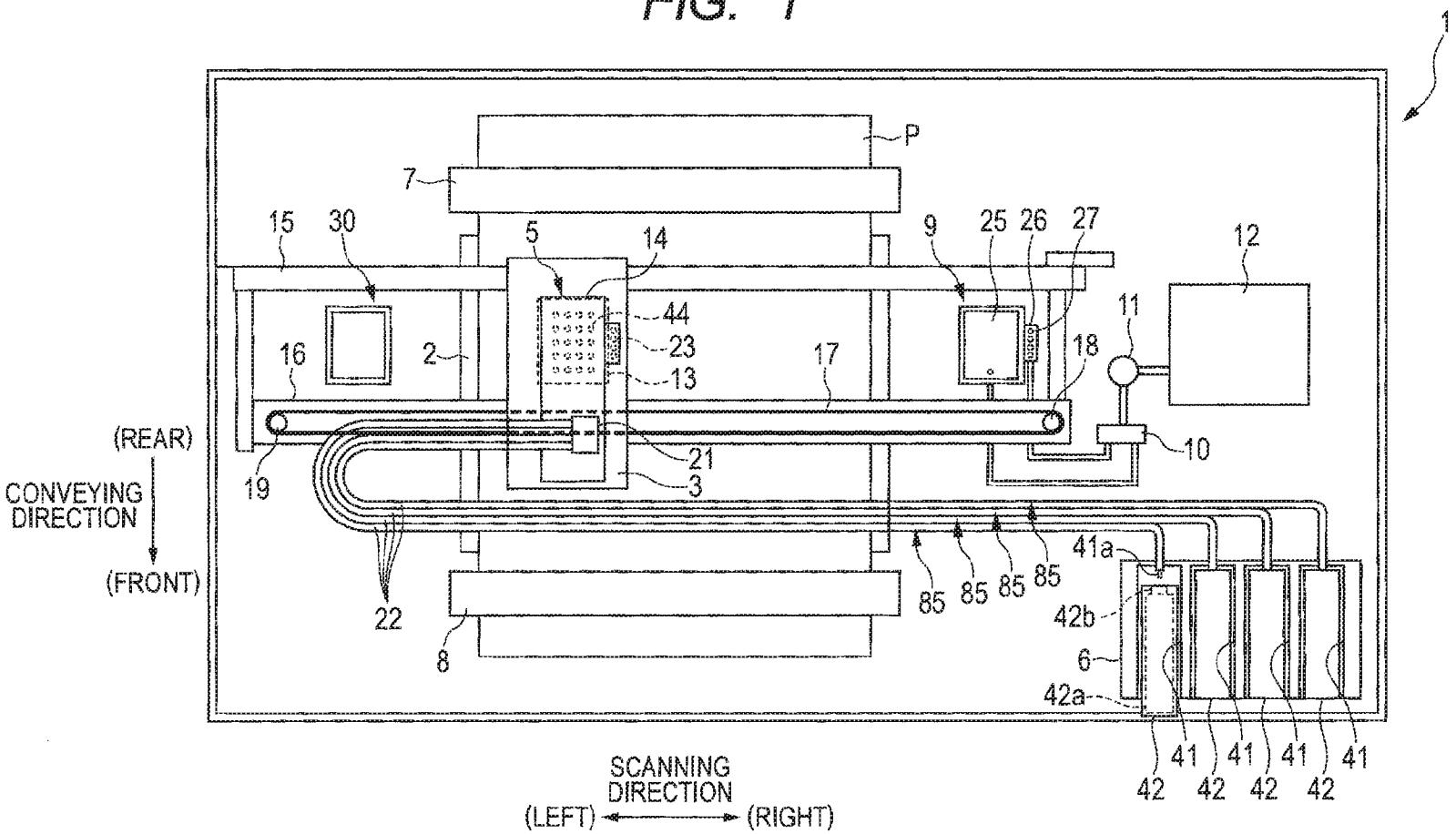
FIG. 1 is a schematic diagram showing an inkjet printer according to an embodiment.

An overall configuration of an inkjet printer 1 (liquid ejecting apparatus) according to an embodiment will be described. As shown in FIG. 1, a printer 1 includes a platen 2, a carriage 3, an inkjet head 5 (hereinafter referred to as "head 5"), a holder 6, a paper feeding roller 7, a paper discharging roller 8, a cap unit 9, a switching device 10, a suction pump 11, a waste-liquid tank 12, a flushing receiver 30, a display 99 (see FIG. 2), and a control device 100 (see FIG. 2). Hereinafter, the near side of the drawing sheet of FIG. 1 is defined as "upper" of the printer 1, and the back side of the drawing sheet of FIG. 1 is defined as "lower" of the printer 1. Further, the front-rear direction and left-right direction shown in FIG. 1 are defined as "front-rear direction" and "left-right direction" of the printer 1. Hereinafter, each word indicative of directions "front", "rear", "left", "right", "upper", and "lower" are used for description appropriately.

Paper P as a recording medium is placed on the upper surface of the platen 2. Further, two guide rails 15, 16 extending in the left-right direction (scanning direction) are provided above the platen 2.

The carriage 3 is mounted on the two guide rails 15, 16, and is movable in the scanning direction along the two guide rails 15, 16 in a region facing the platen 2. A drive belt 17 is attached to the carriage 3. The drive belt 17 is an endless belt looped around two pulleys 18, 19. One pulley 18 is coupled to a carriage drive motor 20 (see FIG. 2). The carriage drive motor 20 drives the pulley 18 to rotate so as to move the drive belt 17, which causes the carriage 3 to move reciprocatingly in the scanning direction. At this time, the head 5 mounted on the carriage 3 moves reciprocatingly in the scanning direction, together with the carriage 3.

The holder 6 includes four cartridge mount portions 41 on which ink cartridges 42 (an example of tank) of four colors (black, yellow, cyan, and magenta) are detachably mounted respectively. Each ink cartridge 42 includes a storage chamber 42*a* storing ink and an outlet pipe 42*b* (an example of supply section) connected to the storage chamber 42*a*. The outlet pipe 42*b* forms a channel for supplying ink stored in the storage chamber 42*a* to outside the ink cartridge 42. The cartridge mount portion 41 includes a needle 41*a* (an example of connection part). When the ink cartridge 42 is mounted, the needle 41*a* is connected to the outlet pipe 42*b* so as to allow ink to flow. The cartridge mount portion 41 also includes a sensor 41*b* (see FIG. 2) for detecting whether the ink cartridge 42 is mounted on the cartridge mount portion 41.

As mentioned above, the head 5 is detachably mounted on the carriage 3. The head 5 includes a head main body 13 and a subsidiary tank 14 (an example of liquid supply member). A tube joint 21 is provided on the upper surface of the subsidiary tank 14. One end of each of four ink supply tubes 22 is detachably connected to the tube joint 21. The other end of each of the four ink supply tubes 22 is connected to the needle 41*a* of a corresponding one of the four cartridge mount portions 41 of the holder 6. Ink in the four ink cartridges 42 mounted on the cartridge mount portions 41 is supplied to the subsidiary tank 14 through the four ink supply tubes 22, respectively.

Four discharge portions 23 corresponding to ink of four colors are provided at the subsidiary tank 14. The discharge portions 23 are for discharging air in the ink channel in the subsidiary tank 14 before the air moves to the head main body 13. A valve (not shown) for switching open/close with the outside is provided within each of the four discharge portions 23.

The head main body 13 is attached to a lower portion of the subsidiary tank 14. The head main body 13 has a plurality of nozzles 44 at the lower surface thereof, and ejects ink supplied from the subsidiary tank 14. The plurality of nozzles 44 is arranged to correspond to ink of four colors, and forms four nozzle arrays. The liquid channel structure within the head main body 13 will be described later in detail.

The paper feeding roller 7 and the paper discharging roller 8 are driven to rotate by a conveying motor 29 (see FIG. 2) in synchronization with each other. The paper feeding roller 7 and the paper discharging roller 8 cooperate to convey paper P placed on the platen 2 in a conveying direction shown in FIG. 1.

The printer 1 ejects ink while conveying paper P in the conveying direction by the paper feeding roller 7 and the paper discharging roller 8 and moving the head 5 together with the carriage 3 in the scanning direction, thereby recording a desired image and so on paper P. That is, the printer 1 of the present embodiment is a serial-type inkjet printer.

The cap unit 9 is disposed at one side of the platen 2 in the scanning direction (the right side in FIG. 1). When the carriage 3 moves to the right side of the platen 2, the carriage 3 faces the cap unit 9 in the vertical direction. The cap unit 9 is driven to move up and down in the vertical direction by a cap drive motor 24 (see FIG. 2). The cap unit 9 includes a nozzle cap 25 and an air discharge cap 26 that can be attached to the head 5.

In a state where the carriage 3 faces the cap unit 9, the nozzle cap 25 faces the lower surface of the head main body 13, and the air discharge cap 26 faces the lower surface of the four discharge portions 23 of the subsidiary tank 14. When the cap unit 9 moves upward in a state where the carriage 3 faces the cap unit 9, the cap unit 9 is attached to the head main body 13 and the subsidiary tank 14. At this time, the nozzle cap 25 covers all the nozzles 44 belonging to four nozzle arrays together, and the air discharge cap 26 is connected to the four discharge portions 23. Four stick-shaped open-close members 27 for opening and closing valves in respective ones of the four discharge portions 23 are attached to the air discharge cap 26. Although detailed descriptions are omitted, in a state where the air discharge cap 26 is connected to the four discharge portions 23, the four stick-shaped open-close members 27 are driven to move vertically by an air discharge motor 28 (see FIG. 2) and are inserted in the discharge portions 23 from the lower side, thereby driving the valves inside.

The nozzle cap 25 and the air discharge cap 26 are connected to the suction pump 11 through the switching device 10. The switching device 10 selectively switches the connection target of the suction pump 11 between the nozzle cap 25 and the air discharge cap 26. The suction pump 11 is connected to the waste-liquid tank 12. By switching the connection target of the switching device 10, it is possible to selectively perform suction purge of forcefully discharging ink from all the nozzles 44 belonging to the four nozzle arrays and air discharge purge of discharging air from ink channels in the subsidiary tank 14.

In the suction purge, in a state where the nozzle cap 25 is attached to the head main body 13 so as to cover the plurality of nozzles 44, after the suction pump 11 is connected to the nozzle cap 25 by the switching device 10, the suction pump 11 is driven to reduce pressure in the nozzle cap 25 (suction) and suck and discharge ink from the plurality of nozzles 44 of the head 5. With this operation, it is possible to discharge foreign matters, air bubbles, high-viscosity ink due to drying, and so on in the head 5 from the nozzles 44 and to recover the ejection characteristics of the nozzles 44.

In the air discharge purge, in a state where the air discharge cap 26 is connected to the discharge portions 23 and the valves in the discharge portions 23 are opened by the open-close members 27, the suction pump 11 is connected to the air discharge cap 26 by the switching device 10 and then the suction pump 11 is driven to apply negative pressure to the discharge portions 23. With this operation, air such as bubbles having grown in the ink channel of the subsidiary tank 14 can be discharged through the discharge portions 23 before the air moves to the head main body 13.

Ink and preservation liquid discharged from the head 5 by the suction purge and the air discharge purge are sent to the waste-liquid tank 12 connected to the suction pump 11.

In the present embodiment, the head 5 performs flushing of ejecting ink from the plurality of nozzles 44 at appropriate timing. This flushing has various purposes that include, for example, preventing drying of ink in the nozzles 44, arranging menisci in the nozzles 44 after suction purge, and so on.

The flushing receiver 30 is a member for receiving ink and so on ejected from the plurality of nozzles 44 at the time of the flushing. The flushing receiver 30 is located at the left end position in the moving range of the head 5 in the scanning direction (hereinafter also referred to as "origin position"). That is, the flushing receiver 30 is located at the other side of the platen 2 in the scanning direction.

When the head 5 moves to the origin position for flushing (see FIG. 7A), the head 5 faces the flushing receiver 30 in the vertical direction. When flushing is performed in this state, ink ejected from the plurality of nozzles 44 of the head 5 is received by the flushing receiver 30.

Figure 2:
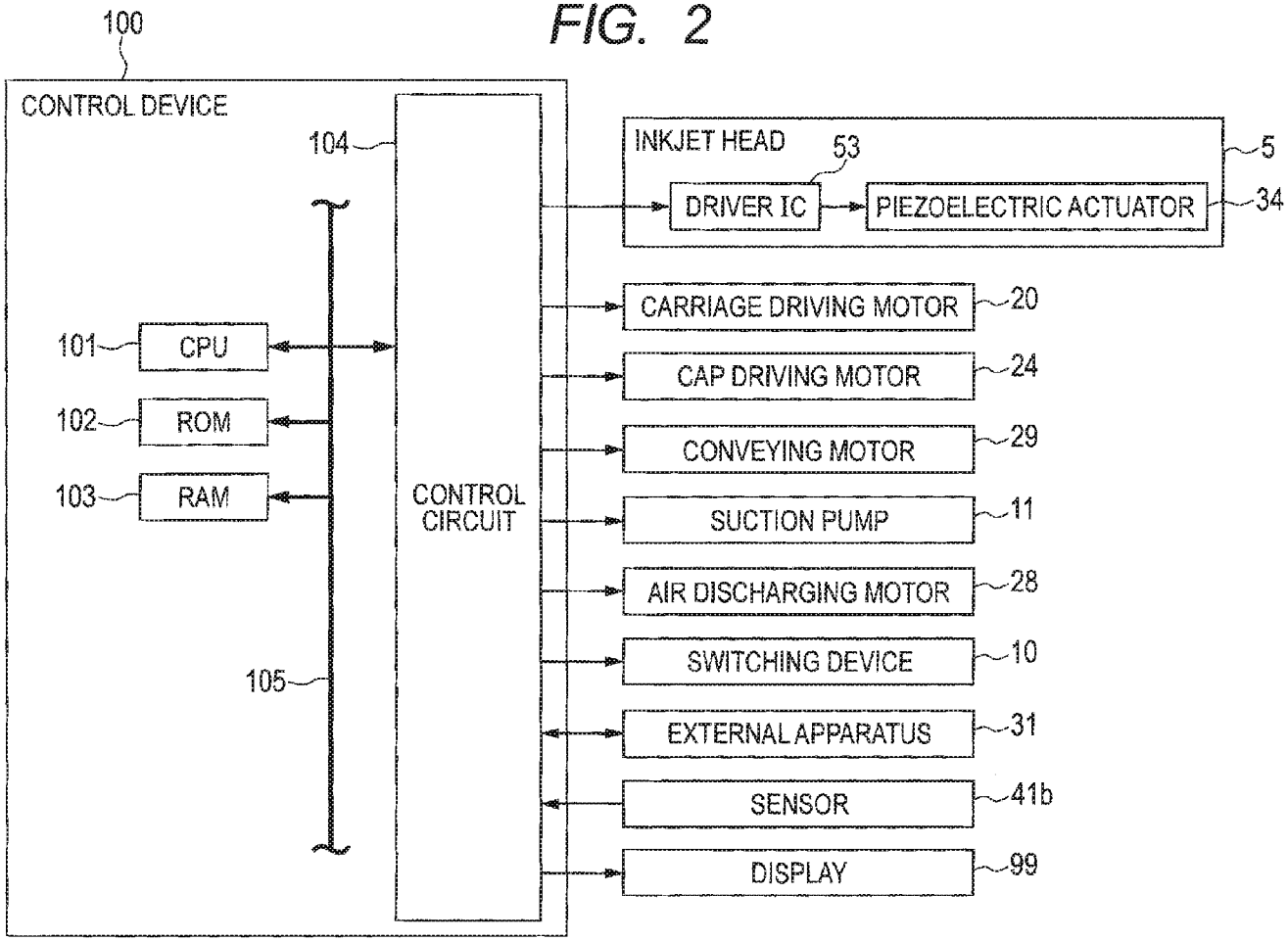
FIG. 2 is a block diagram schematically showing the electrical configuration of the inkjet printer.

As shown in FIG. 2, the control device 100 includes a CPU (Central Processing Unit) 101, a ROM (Read Only Memory) 102, a RAM (Random Access Memory) 103, a control circuit 104, a bus 105, and so on. The ROM 102 stores programs executed by the CPU 101, various fixed data, and so on. The RAM 103 temporarily stores data (image data and so on) needed for executing programs. The control circuit 104 is connected to various devices and drivers of the printer 1, such as a driver IC 53 of the head 5, the carriage drive motor 20, and the cap drive motor 24 that moves the cap unit 9 up and down. The control circuit 104 is also connected to an external apparatus 31 such as a PC. Based on a recording command transmitted from the external apparatus 31, the CPU 101 controls the head 5, the carriage drive motor 20, and so on, through the control circuit 104 to record an image and the like on paper P. The CPU 101 also controls the switching device 10, the suction pump 11, and so on, through the control circuit 104 to perform the above-described suction purge and air discharge purge. In the present embodiment, the control device 100 is so configured that a single CPU executes each process. However, the control device 100 may be so configured that a plurality of CPUs, a single ASIC (application specific integrated circuit), a plurality of ASICs, or a combination of a CPU and a specific ASIC executes each process.

Figure 3:
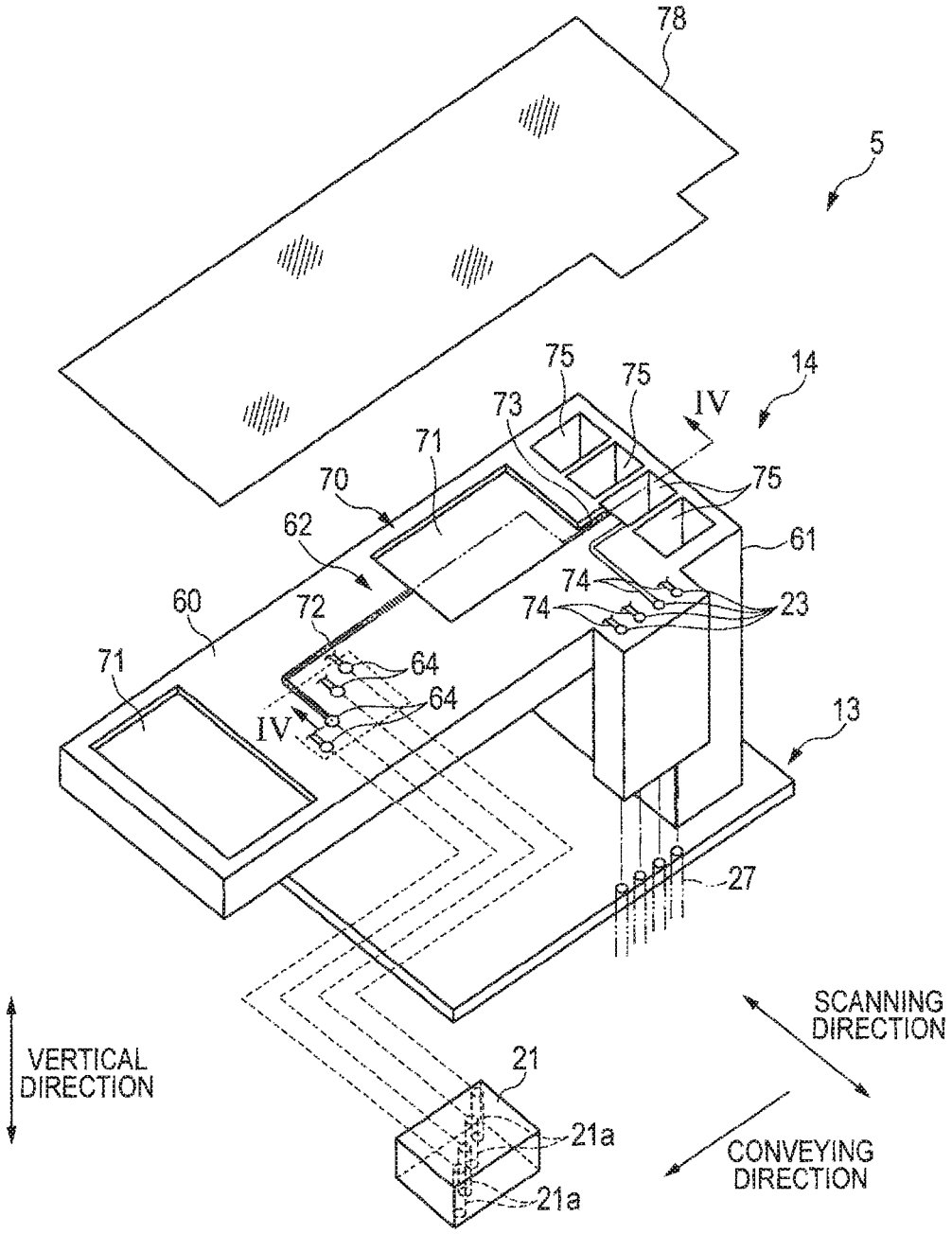
FIG. 3 is a perspective view of the inkjet head.
Figure 4A:
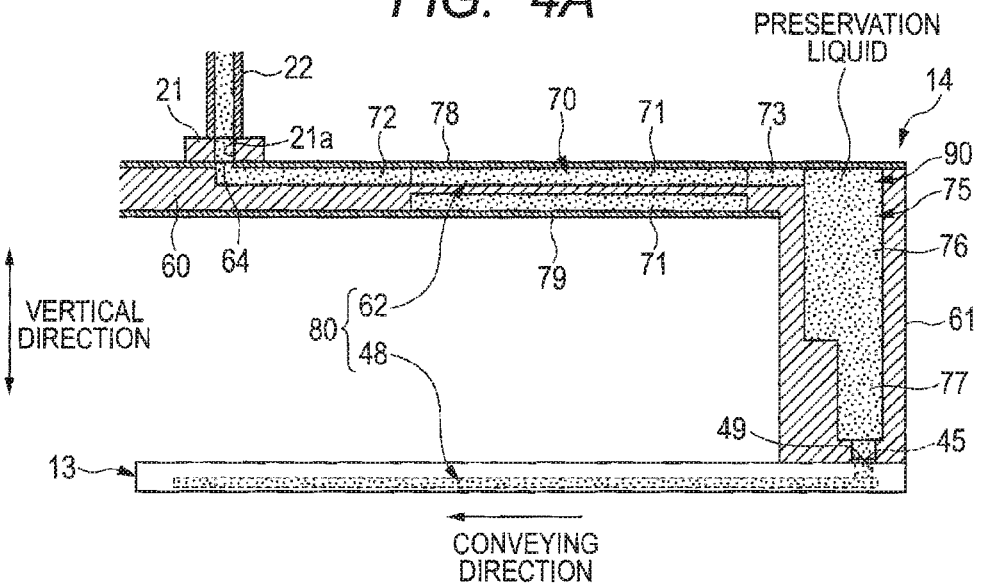
FIGS. 4A and 4B are vertical cross-sectional views as viewed in the direction of arrow IV-IV in FIG. 3.
Figure 4B:
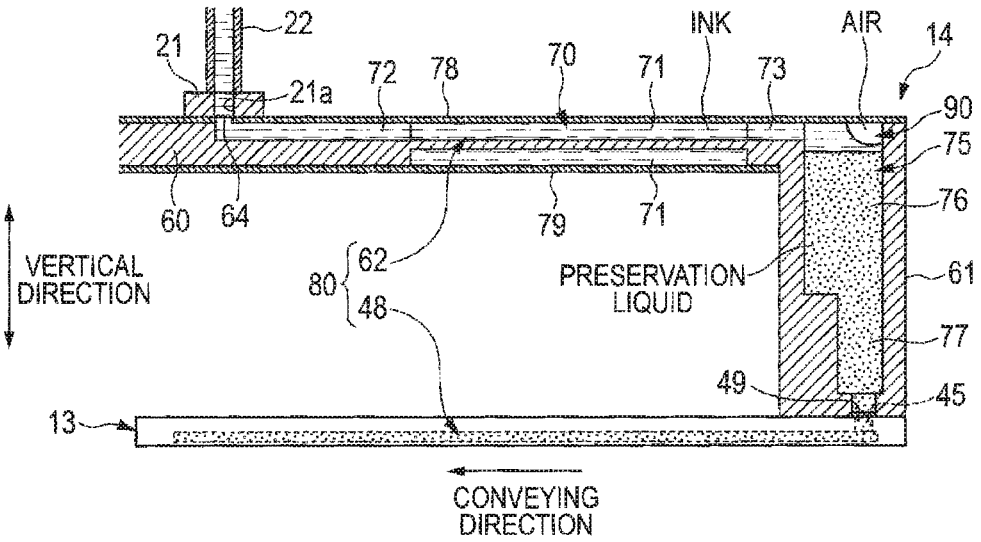

Next, the head 5 will be described while referring to FIGS. 3 to 6B. In FIG. 3, the open-close members 27 for opening and closing the discharge portions 23 of the subsidiary tank 14 are shown by the two-dot chain lines. In FIGS. 4A and 4B, the head main body 13 is shown by a side view, not a cross-sectional view.

Figure 5:
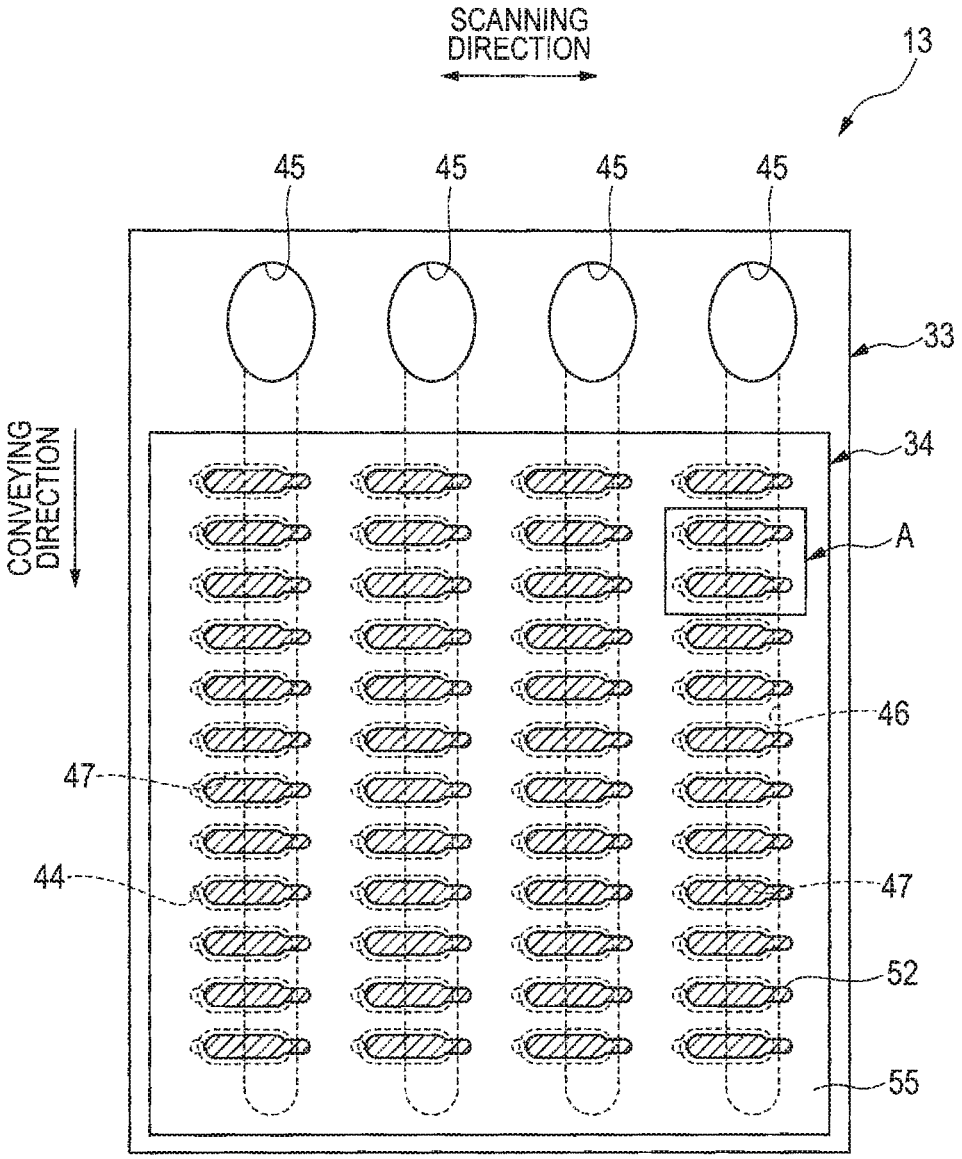
FIG. 5 is a plan view of a head main body of the inkjet head.
Figure 6A:
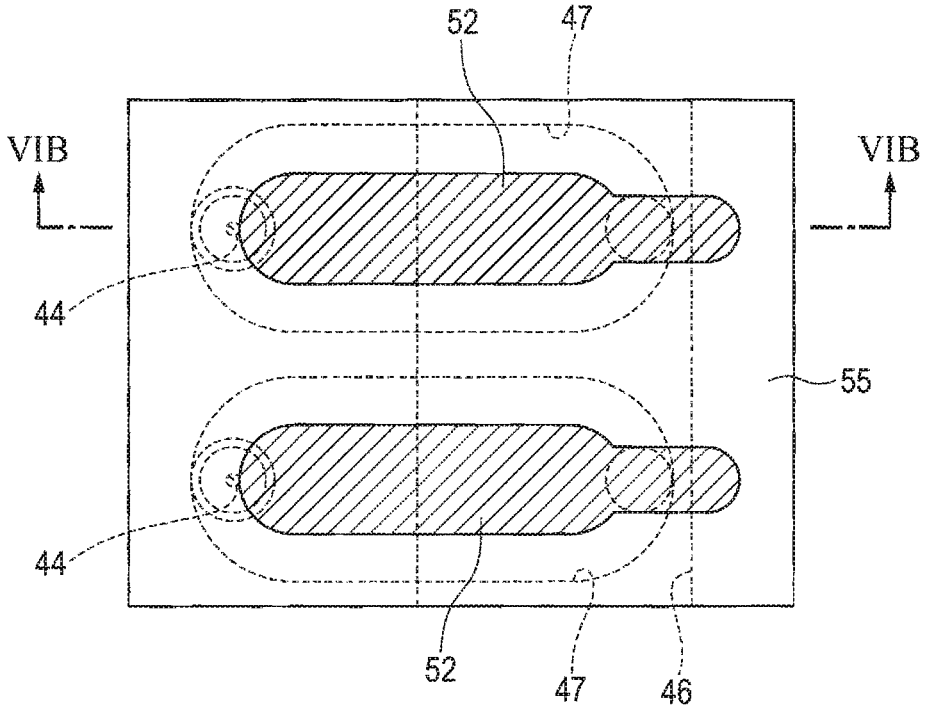
FIG. 6A is an enlarged view of a part A in FIG. 5.
Figure 6B:
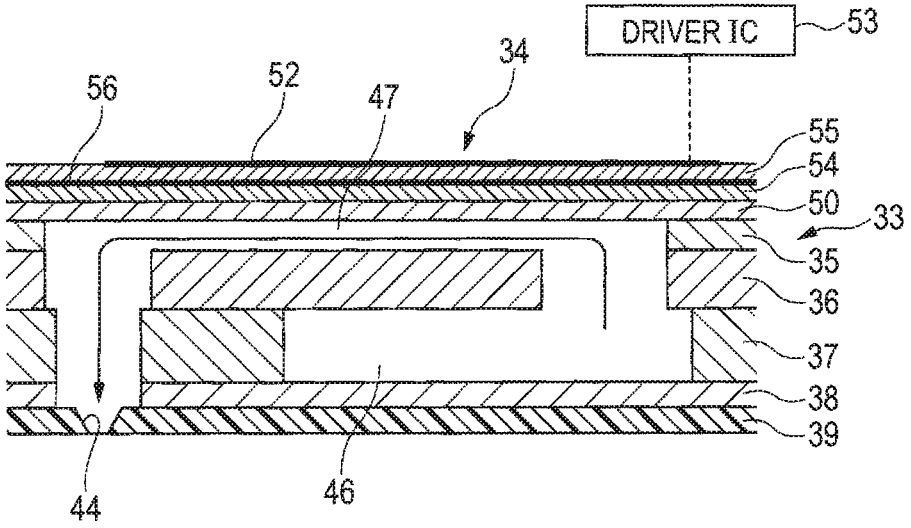
FIG. 6B is a cross-sectional view as viewed in the direction of arrow VIB-VIB in FIG. 6A.

As shown in FIGS. 5, 6A, and 6B, the head main body 13 of the head 5 includes a channel unit 33 and a piezoelectric actuator 34 (an example of an energy generator). As shown in FIG. 6B, the channel unit 33 has a structure that five plates 35 to 39 are stacked. The plate 39 of the lowermost layer of the five plates 35 to 39 is the nozzle plate 39 in which the plurality of nozzles 44 is formed. The remaining four plates 35 to 38 at the upper side are formed with channels such as manifolds 46 and pressure chambers 47 in communication with the plurality of nozzles 44.

As shown in FIG. 5, four ink supply holes 45 are formed to be aligned in the scanning direction on the upper surface of the channel unit 33. The four ink supply holes 45 are connected to the subsidiary tank 14, and ink in four colors is supplied from the subsidiary tank 14 to respective ones of the four ink supply holes 45. The channel unit 33 has therein the four manifolds 46 each extending in the conveying direction. The four manifolds 46 are in communication with the four ink supply holes 45.

As shown in FIGS. 4A and 4B, a filter 49 for removing dusts and so on in ink supplied from the supply channel 62 is provided on the upper surface of the four ink supply holes 45. The filter 49 suppresses air in the supply channel 62 from flowing into the head main body 13.

The channel unit 33 further has the plurality of nozzles 44 opened in the lower surface thereof and the plurality of pressure chambers 47 in communication with respective ones of the plurality of nozzles 44. As shown in FIG. 5, in a plan view, the plurality of nozzles 44 is arranged in four rows so as to correspond to the respective four manifolds 46. Similar to the plurality of nozzles 44, the plurality of the pressure chambers 47 is arranged in four rows so as to correspond to the respective four manifolds 46. As shown in FIG. 6B, each pressure chamber 47 is in communication with a corresponding one of the manifolds 46. With the above configuration, as indicated by the arrow in FIG. 6B, a plurality of individual channels branching from each manifold 46 and reaching the nozzles 44 through the pressure chambers 47 is formed in the channel unit 33. Hereinafter, the ink channel formed in the channel unit 33, such as the manifolds 46, the pressure chambers 47, and the nozzles 44 are collectively referred to as a head channel 48 (see FIGS. 4A and 4B).

As shown in FIGS. 5, 6A, and 6B, the piezoelectric actuator 34 includes a vibration plate 50, piezoelectric layers 54 and 55, a plurality of individual electrodes 52, and a common electrode 56. The vibration plate 50 is bonded to the upper surface of the channel unit 33 in a state where the vibration plate 50 covers the plurality of the pressure chambers 47. The two piezoelectric layers 54, 55 are stacked on the upper surface of the vibration plate 50. The plurality of individual electrodes 52 is arranged on the upper surface of the upper piezoelectric layer 55 so as to correspond to the respective ones of the plurality of the pressure chambers 47. The common electrode 56 is disposed between the two piezoelectric layers 54 and 55 so as to span the plurality of the pressure chambers 47.

When a signal is received from the control device 100 and a drive signal is supplied from the driver IC 53 to the individual electrode 52 of the piezoelectric actuator 34, piezoelectric distortion is generated at a portion of the upper piezoelectric layer 55 corresponding to the pressure chamber 47, thereby deforming the vibration plate 50 to be deflected. At this time, because the volume of the pressure chamber 47 changes, pressure (energy) is applied to ink in the individual channel and ink is ejected from the nozzle 44.

Next, the subsidiary tank 14 will be described in detail. The subsidiary tank 14 is a member formed by synthetic resin. As shown in FIGS. 3, 4A, and 4B, the subsidiary tank 14 has a plate-shaped main body portion 60 extending along a horizontal surface and a linking portion 61 extending vertically downward from one end of the main body portion 60.

In the subsidiary tank 14, four supply channels 62 for supplying the head main body 13 with ink in respective four colors are formed. In the main body portion 60, four ink introducing portions 64 are formed to correspond to ink in respective four colors. The four supply channels 62 are in communication with respective ones of the four introducing portions 64. The four ink introducing portions 64 are provided on the upper surface of the plate-shaped main body portion 60. Note that FIG. 3 shows only the connection configuration of the supply channel 62 corresponding to ink in a certain color. Ink in four colors introduced from the four ink introducing portions 64 of the subsidiary tank 14 flows into the head channel 48 of the head main body 13 by way of the supply channel 62.

A tube joint 21 is attached to the upper surface of the main body portion 60. The tube joint 21 is connected to four ink supply tubes 22 each connected to the ink cartridge 42 (see FIG. 1). Four in-joint channels 21*a* for allowing fluid communication between the four ink supply tubes 22 and the corresponding four ink introducing portions 64 are formed within the tube joint 21.

Each supply channel 62 has a main channel 70 (an example of a second channel) formed in the main body portion 60 and a linking channel 75 (an example of a first channel) formed in the linking portion 61. As shown in FIGS. 4A and 4B, the main channel 70 extends along a horizontal surface. The linking channel 75 is connected to one end of the main channel 70, and extends vertically downward from this one end. With this configuration, a connection corner portion 90 having a 90 deg. angle is formed at a connection portion of the main channel 70 and the linking channel 75. The connection corner portion 90 is located at the uppermost position in the main channel 70 and the linking channel 75, which is the same as each position of the main channel 70. In the present embodiment, the connection corner portion 90 is located at the same height as the entirety of the main channel 70. As a modification, the connection corner portion 90 may be located at a higher position than the main channel 70, and a damper chamber 71 (described below) may be connected to the connection corner portion 90 by an upsloping channel.

The main channel 70 has the damper chamber 71 and channels 72, 73 arranged at the front and rear of the damper chamber 71. The damper chamber 71 is a concave portion formed in the surface of the main body portion 60. Two of the four damper chambers 71 corresponding to ink in four colors are provided at the upper surface of the main body portion 60, and the other two are provided at the lower surface of the main body portion 60. As shown in FIGS. 4A and 4B, the damper chambers 71 at the upper surface and the damper chambers 71 at the lower surface are arranged back to back (arranged in the vertical direction). Further, the ink introducing portions 64 and the damper chamber 71 formed in the upper surface of the main body portion 60 are connected by the groove-shaped channel 72 that is formed in the upper surface of the main body portion 60.

The damper chamber 71 is connected to the linking channel 75 formed in the linking portion 61, by the channel 73 formed in the upper surface of the main body portion 60. Although omitted in FIG. 3 for simplicity, regarding ink in other colors, the ink introducing portions 64, the damper chambers 71, and the linking channels 75 are connected by channels formed in the upper surface or the lower surface of the main body portion 60, thereby forming the supply channel 62.

In the main body portion 60, four groove-shaped air discharge channels 74 are also formed to connect the four linking channel 75 with the corresponding four discharge portions 23. Regarding the air discharge channel 74, too, for simplicity, only one air discharge channel 74 formed in the upper surface of the main body portion 60 is shown in the drawing and the other air discharge channels 74 are omitted.

As shown in FIGS. 3, 4A, and 4B, flexible films 78, 79 made of resin material are welded to the upper surface and the lower surface of the main body portion 60. With this configuration, the concave damper chamber 71, the groove-shaped channels 72, 73, and the groove-shaped air discharge channels 74 of the supply channel 62 formed in the main body portion 60 are covered by the films 78, 79 from upward or downward.

The concave damper chamber 71 and the channels 72, 73 have approximately the same depth, but the channel width of the damper chamber 71 is considerably larger than the channel width of the groove-shaped channels 72, 73. With this configuration, the supply channel 62 has a channel shape that the volume is locally large at the damper chamber 71. When ink is consumed in the head main body 13, pressure of ink in the head main body 13 drops. Hence, ink is supplied from the ink cartridge 42 to the supply channel 62 in the subsidiary tank 14. At this time, if large pressure fluctuation is generated in ink in the supply channel 62, the pressure fluctuation is transmitted to the head main body 13 and adversely affects ink ejection. Because the supply channel 62 has the damper chambers 71 having large volume and covered by the flexible films 78, 79, the damper chambers 71 absorb pressure fluctuation generated in ink in the supply channel 62.

The upper ends of the four linking channels 75 formed in the linking portion 61 are closed by the film 78, while the lower ends of the four linking channels 75 are connected to the four ink supply holes 45 of the head 5. As mentioned above, the linking channel 75 extend in the vertical direction, and the connection corner portion 90 between the linking channel 75 and the main channel 70 is located at the uppermost position in these channels 70, 75. Hence, air in the supply channel 62 does not flow into the head main body 13 and tends to stay at the upper end of the linking channel 75. This suppresses a situation in which the air in the supply channel 62 flows into the head main body 13 and hence the ejection characteristics of the head 5 deteriorate. As shown in FIGS. 4A and 4B, the linking channel 75 includes an upper channel 76 having a larger channel cross-sectional area (channel width) and a lower channel 77 having a smaller channel cross-sectional area.

Hereinafter, for description purposes, the channel including the supply channel 62 and the head channel 48 is referred to as an in-head channel 80. Further, the entire channel from the connection position of the ink supply tube 22 and the ink cartridge 42 to the plurality of nozzles 44 is referred to as an entire ink channel 85 (see FIG. 1). That is, the entire ink channel 85 includes the in-head channel 80, the ink supply tube 22, and the in-joint channel 21*a*. The entire ink channel 85 is an example of "liquid channel" of the present disclosure. Further, the unit including the head 5, the tube joint 21, and the ink supply tube 22 is an example of "head unit" of the present disclosure.

In the above-described head 5, as shown in FIG. 4A, before the head 5 is shipped from a factory, preservation liquid is filled in the in-head channel 80 and so on of the entire ink channel 85 for the purpose of maintaining functions of the head 5. If pigment-based ink is used as the preservation liquid, for example, the following issue may occur. Color material used as pigment-based ink sometimes agglutinates over time. Hence, if pigment-based ink is filled in the in-head channel 80 of the head 5 for a long period, there is a possibility that ejection malfunction occurs.

Thus, in the present embodiment, liquid containing less color material of dye or pigment than ink or liquid containing no color material is used as the preservation liquid. This preservation liquid is considerably less expensive than ink due to less color material. Further, surfactant is added to the preservation liquid and hence the preservation liquid has lower surface tension than ink does, so that the preservation liquid is easily introduced to fine portions of the in-head channel 80 at the time of being filled into the in-head channel 80.

When a user turns on the power of the purchased printer 1 on which the head 5 is mounted for the first time after shipment, the control device 100 performs a replacing process of replacing preservation liquid filled in the in-head channel 80 of the head 5 with ink introduced from the ink cartridge 42.

When the control device 100 performs a discharging process of discharging liquid in the in-head channel 80 to outside the in-head channel 80, such as suction purge and flushing, ink of the amount of discharged liquid is introduced from the ink cartridge 42 into the in-head channel 80. Accordingly, in the replacing process, the control device 100 could replace liquid in the in-head channel 80 with ink by performing this discharging process. However, the inventor of the present application found that, only by performing the discharging process, a large amount of preservation liquid remains in the in-head channel 80. The reason will be described below. In the following descriptions, it is assumed that preservation liquid is filled in the entire ink channel 85 at the time of starting the replacing process (at the time of starting the introducing process described later).

As described above, the damper chamber 71 is a locally enlarged channel portion having a larger channel cross-sectional area than the channels 72, 73 formed at the front and rear of the damper chamber 71. Hence, in the damper chamber 71, there is a stagnation portion where liquid tends to stagnate. Further, the connection corner portion 90 between the main channel 70 and the linking channel 75 is a channel portion where flow of liquid changes its direction downward. Hence, at the connection corner portion 90, a portion of relatively slow liquid flow tends to be generated, and liquid tends to stagnate. Even if a liquid flow from the ink cartridge 42 toward the nozzles 44 is generated in the entire ink channel 85 by flushing or suction purge, it is difficult to discharge, from the nozzles 44, preservation liquid in the channel portion where liquid tends to stagnate. As a result, only by simply performing the discharging process, a large amount of preservation liquid stays at a particular channel portion in the in-head channel 80 where liquid tends to stagnate. In this way, there is a problem that, if the printer 1 is used in a state where preservation liquid remains in the in-head channel 80, ink mixed with preservation liquid is ejected from the nozzles 44 and the quality of images recorded on paper P deteriorates.

Hence, in the present embodiment, in the replacing process, in addition to the above-mentioned discharging process, the control device 100 performs an introducing process of introducing ink into the in-head channel 80 and an agitating process of agitating liquid in the in-head channel 80, before the discharging process. The control device 100 repeatedly performs N times of a set of the agitating process and the discharging process (N is an integer larger than or equal to 2; N is 85 in the present embodiment). In the replacing process, after repeatedly performing the agitating process and the discharging process, the control device 100 also performs an air discharging process of discharging air in the in-head channel 80. The flow of the replacing process will be described in detail below.

The control device 100 first controls the cap unit 9 and the suction pump 11 to perform an introducing process of discharging at least part of preservation liquid in the in-head channel 80 to outside the in-head channel 80 and introducing ink from the ink cartridge 42 into the entire ink channel 85. Specifically, in the introducing process, the control device 100 performs air discharge purge so as to discharge air excessively existing in the supply channel 62. After that, the control device 100 performs suction purge so that ink in the ink cartridge 42 reaches the connection corner portion 90 between the main channel 70 and the linking channel 75 in the supply channel 62.

In the introducing process, for the purpose of improving efficiency of agitating liquid in the subsequent agitating process, the control device 100 controls the suction pump 11 such that at least part of air in the entire ink channel 85 stays at a particular channel portion of the in-head channel 80 at which preservation liquid exists before starting the introducing process and liquid tends to stagnate. In the present embodiment, the control device 100 controls the suction power and the driving period of the suction pump 11 such that air stays at the connection corner portion 90 between the main channel 70 and the linking channel 75. Specifically, the control device 100 controls the suction pump 11 such that the total discharge amount of liquid discharged from the supply channel 62 to outside the supply channel 62 at the time of air discharge purge and suction purge corresponds to the volume from the connection position of the needle 41*a* to the connection corner portion 90 in the entire ink channel 85. With this operation, at least part of air that enters the entire ink channel 85 when the ink cartridge 42 is mounted on the cartridge mount portion 41 and the ink cartridge 42 is connected to the entire ink channel 85 (air that enters at connection, and so on) can be moved to the connection corner portion 90 between the main channel 70 and the linking channel 75. Here, the "total discharge amount" is the discharge amount estimated by deeming that air discharged by air discharge purge and so on in the introducing process is liquid. Accordingly, the total discharge amount may differ from the amount of liquid that is actually discharged, by the amount of discharged air. In the present embodiment, in suction purge in the introducing process, the rotational speed (suction power) of the suction pump 11 is the same as the rotational speed at normal suction purge for recovering the ejection characteristics of the nozzles 44.

Moisture of liquid in the supply channel 62 may evaporate over time. When moisture evaporates, air of the amount of the evaporated moisture is generated in the supply channel 62. Accordingly, before starting the introducing process, there are cases that air already exists in the supply channel 62. In addition, the agitation efficiency of liquid in the agitating process is higher as there is a larger amount of air staying in the supply channel 62 (the connection corner portion 90). Accordingly, in the introducing process, for the purpose of improving the agitation efficiency of liquid in the agitating process, the control device 100 may control the suction pump 11 such that air already existing in the supply channel 62 stays at the connection corner portion 90, in addition to the above-mentioned air that enters at connection. Specifically, in the introducing process, the control device 100 controls the suction pump 11 to operate in a slower rotational speed (lower suction power) than the normal suction purge so that air stays at the connection corner portion 90. However, if the rotational speed of the suction pump 11 is decreased, a processing period needed for discharging liquid of the above-mentioned total discharge amount to outside the supply channel 62 becomes longer. Accordingly, in the introducing process, it is preferable to drive the suction pump 11 at the same rotational speed as the normal suction purge when a user wishes to shorten the processing period of the introducing process, and to drive the suction pump 11 at a lower rotational speed than the normal suction purge when a user wishes to improve the agitation efficiency of liquid in the agitating process.

When the introducing process ends, the control device 100 repeatedly performs N times of a set of the agitating process and the discharging process.

Figure 7A:
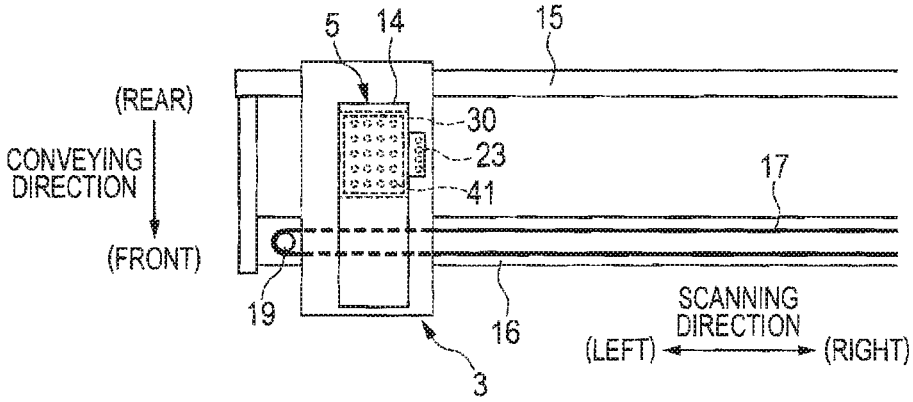
FIGS. 7A and 7B are plan views for illustrating an agitating process.

In the agitating process, as shown in FIG. 7A, the control device 100 first controls the carriage drive motor 20 to move the head 5 to the origin position facing the flushing receiver 30 in the vertical direction. After that, the control device 100 controls the carriage drive motor 20 to reciprocatingly move the head 5 together with the carriage 3 in the scanning direction (see FIGS. 7A and 7B). With this operation, power (energy) is applied to liquid in the in-head channel 80 and flow of the liquid is generated, and the liquid in the in-head channel 80 is agitated.

The moving operation of the carriage 3 in the scanning direction is classified into three of an accelerating operation, a constant-velocity operation, and a decelerating operation in terms of the moving velocity of the carriage 3. The constant-velocity operation is an operation of moving the carriage 3 at a constant velocity, and is used at the time of image recording in which ink is ejected from the head 5 toward paper P, for example. The accelerating operation is an operation used for accelerating the carriage 3 in a stopped state to a particular velocity, for example. The decelerating operation is an operation used for stopping the carriage 3 that is moving at the particular velocity, for example.

Figure 7B:
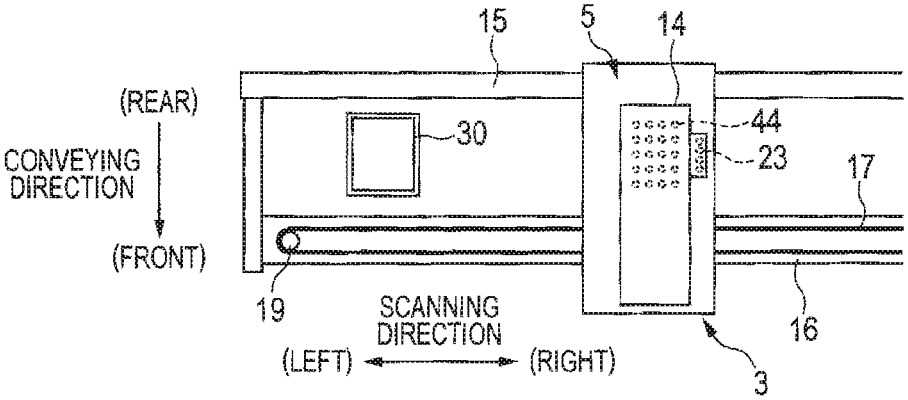
Figure 7C:
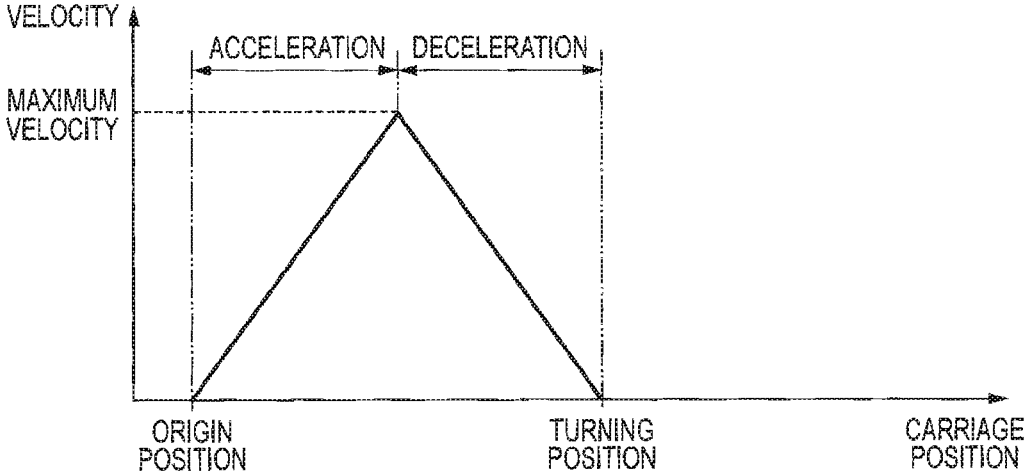
FIG. 7C is a diagram showing a relationship between the moving velocity and the position of a carriage.

It is in the accelerating operation of accelerating the carriage 3 or the decelerating operation of decelerating the carriage 3 when large power (energy) is applied to liquid in the in-head channel 80. Hence, in the present embodiment, as shown in FIG. 7C, during one way (outbound) movement, the control device 100 performs the accelerating operation of accelerating the carriage 3 from the origin position to the particular velocity (in the present embodiment, the maximum velocity of the carriage 3), and immediately after that (without performing a constant-velocity operation), performs the decelerating operation for stopping the carriage 3 at the turn position (see FIG. 7B). During return movement, the control device 100 performs the accelerating operation of accelerating the carriage 3 from the turn position to the particular velocity and, immediately after that (without performing a constant-velocity operation), performs the decelerating operation and returns the carriage 3 to the origin position. By operating the carriage 3 as described above, the moving distance of the one way movement of the carriage 3 is the same as the moving distance of the return movement of the carriage 3, which enables the position of the head 5 at the end of the return movement to be the origin position. As will be described later, the discharging process performed after each agitating process is flushing of ejecting ink from the plurality of nozzles 44 of the head 5 toward the flushing receiver 30. Accordingly, because the position of the head 5 at the end of each agitating process is the origin position at which the head 5 faces the flushing receiver 30, the processing period needed for the replacing process can be shortened. As described above, in the present embodiment, liquid in the in-head channel 80 can be agitated only by control of the carriage 3 that is an already-existing element of the printer 1. In FIGS. 7A and 7B, for description purposes, the elements of the printer 1 that are not relating to the agitating process are omitted.

When the agitating process ends, the control device 100 performs the discharging process of discharging liquid in the in-head channel 80 agitated by the agitating process from the nozzles 44. In this discharging process, liquid in the in-head channel 80 is in a state agitated by the above-described agitating process. Thus, it is possible to also discharge preservation liquid that was in a channel portion before the agitating process where it is difficult to discharge preservation liquid only by the discharging process.

If, in each agitating process, air stays at a particular channel portion in the in-head channel 80, due to existence of this air, liquid flows more easily around the particular channel portion than when air does not exist. As a result, when air exists in the particular channel portion, agitation of liquid in the in-head channel 80 is facilitated. As described above, in the agitating process for the first time, air stays at the connection corner portion 90 between the main channel 70 and the linking channel 75 as a result of the introducing process. Here, the connection corner portion 90 is the particular channel portion of the in-head channel 80 at which liquid tends to stagnate. Hence, the agitation efficiency of liquid around the connection corner portion 90 is high. In the agitating process for the second time and thereafter, it is preferable that air stay at the connection corner portion 90, considering the agitation efficiency. In addition, after the agitating process and the discharging process are repeated N times, the air discharging process of discharging air in the in-head channel 80 is performed. So, it is unnecessary to discharge air in the in-head channel 80 by the discharging process. Hence, in the present embodiment, in each discharging process, the control device 100 performs flushing of controlling the piezoelectric actuator 34 to discharge liquid in the in-head channel 80 from the nozzles 44.

In this way, by performing each discharging process with flushing in which flow of liquid generated in the in-head channel 80 is relatively small, at the time of the agitating process for the second time and thereafter, too, air stays at the particular channel portion of the in-head channel 80. As a result, the agitation efficiency of liquid in the in-head channel 80 in each agitating process can be improved. In addition, it is easier to control (adjust) the discharge amount of liquid in flushing than in suction purge. This suppresses liquid more than a set discharge amount from being discharged from the in-head channel 80 in each discharging process. As a result, the amount of ink consumed in the discharging process can be reduced.

In the present embodiment, the above-mentioned set discharge amount set in each discharging process is the liquid amount corresponding to the volume of the lower channel 77 in the linking channel 75. The lower channel 77 has a smaller channel cross-sectional area than the upper channel 76 and is a channel in which air does not tend to stay. Hence, in the lower channel 77, agitation of liquid is not facilitated in the agitating process compared with the upper channel 76, and preservation liquid in the lower channel 77 is mainly discharged by the flow of liquid in the channel at the time of the discharging process. Accordingly, by setting the discharge amount in each discharging process to the liquid amount corresponding to the volume of the lower channel 77, a major part of preservation liquid in the lower channel 77 can be discharged to outside the lower channel 77. As a result, while reducing the amount of ink discharged in the replacing process, preservation liquid remaining in the in-head channel 80 after the replacing process can be reduced efficiently.

As described above, by repeating the agitating process and the discharging process N times, the amount (density) of preservation liquid in the in-head channel 80 can be reduced gradually. Hence, at the end of the replacing process, preservation liquid remaining in the in-head channel 80 can be reduced reliably. The number of times N of repeating the agitating process and the discharging process is a number of times needed for reducing a color difference between ink stored in the ink cartridge 42 and liquid ejected from the nozzles 44 to a particular value or less. The number of times N is preliminarily set by experiments, simulations, or the like.

After repeatedly performing the agitating process and the discharging process N times, the control device 100 performs the air discharging process of controlling the cap unit 9 and the suction pump 11 to discharge air in the in-head channel 80 to outside the in-head channel 80. Specifically, in the air discharging process, the control device 100 performs the above-described suction purge. In the suction purge in the air discharging process, by making the suction power of the suction pump 11 stronger than the suction purge in the introducing process, air in the in-head channel 80, together with liquid, is discharged forcefully from the nozzles 44. That is, the suction power of the suction pump 11 is made strong so that air in the supply channel 62 also passes through the filter 49 and is discharged from the nozzles 44. This suppresses worsening of the ejection characteristics of ink of the head 5 due to air in the in-head channel 80.

<Operation of Inkjet Printer>

Figure 8:
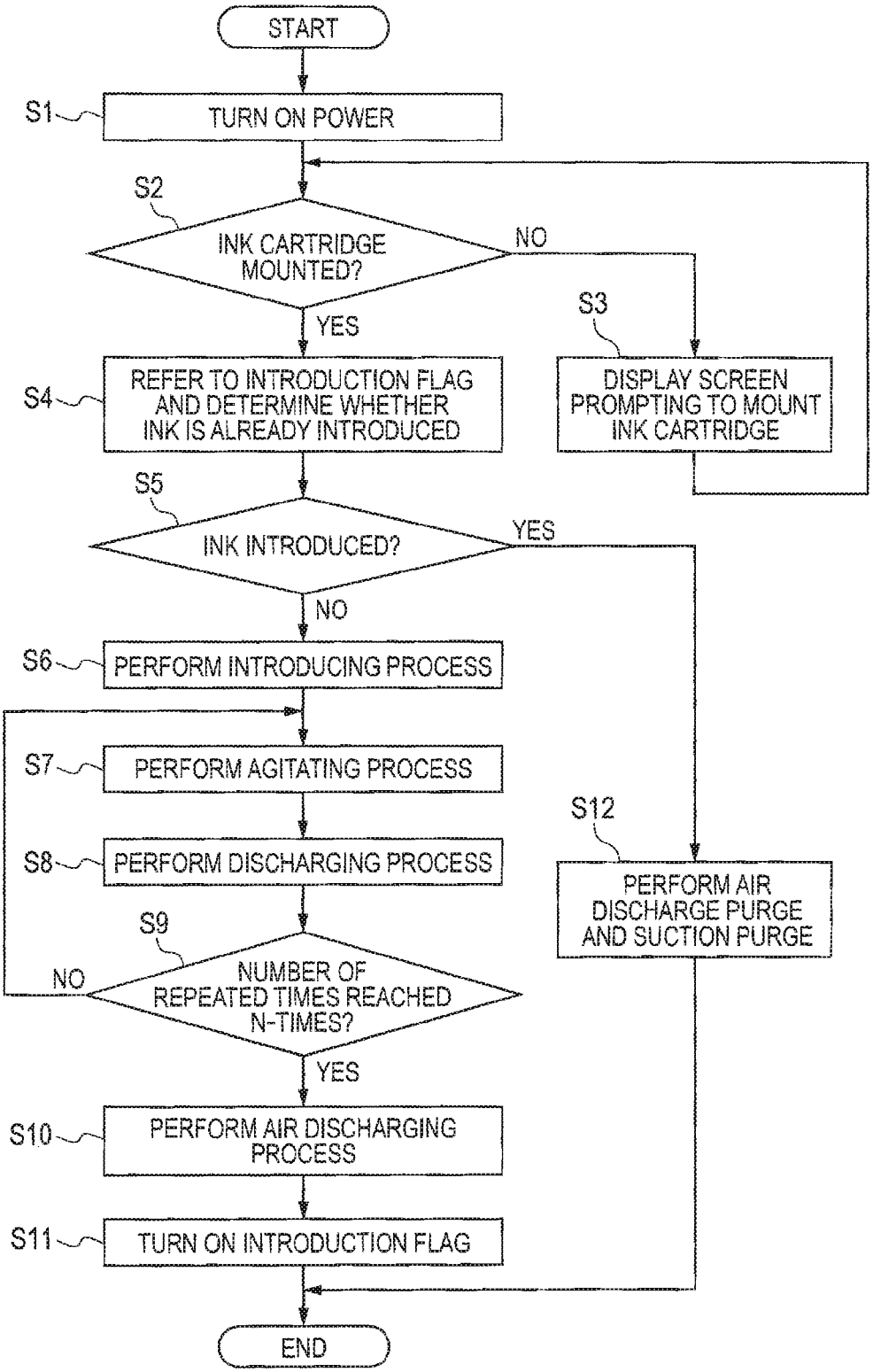
FIG. 8 is a flowchart showing processing operations of the inkjet printer.

Next, an example of the operation of the printer 1 when a user turns on the power of the printer 1 will be described while referring to FIG. 8.

When the user turns on the power of the printer 1 (S1), the CPU 101 determines whether the ink cartridge 42 is mounted on the cartridge mount portion 41, based on the detection result of the sensor 41*b* (S2). When it is determined that the ink cartridge 42 is not mounted on the cartridge mount portion 41 (S2: NO), the CPU 101 controls the display 99 to display a screen prompting to mount the ink cartridge 42 on the cartridge mount portion 41 (S3), and returns to the process in S2.

On the other hand, when it is determined that the ink cartridge 42 is mounted on the cartridge mount portion 41 (S2: YES), the CPU 101 reads to a nonvolatile memory (not shown) and determines whether ink has been introduced in the in-head channel 80 of the head 5 mounted on the carriage 3 (whether the head is brand-new) (S4). Specifically, the nonvolatile memory (not shown) stores an introduction flag indicative of whether ink has been introduced in the in-head channel 80 after shipment. When the introduction flag is ON, the CPU 101 determines that ink has been introduced in the in-head channel 80 and that preservation liquid does not exist in the in-head channel 80. On the other hand, when the introduction flag is OFF, the CPU 101 determines that ink has not been introduced in the in-head channel 80 and that preservation liquid exists in the in-head channel 80.

When it is determined that ink has not been introduced in the in-head channel 80 of the head 5 (preservation liquid exists) (S5: NO), the CPU 101 determines that the replacing process is to be performed. First, the CPU 101 performs the introducing process of controlling the cap unit 9 and the suction pump 11 to discharge at least part of preservation liquid in the in-head channel 80 to outside the in-head channel 80, thereby introducing ink in the ink cartridge 42 into the entire ink channel 85 (S6).

Next, the CPU 101 performs the agitating process of agitating liquid in the in-head channel 80 by controlling the carriage 3 to move the head 5 in the scanning direction (S7). Next, the CPU 101 performs the discharging process of controlling the piezoelectric actuator 34 to perform flushing, thereby discharging liquid in the in-head channel 80 agitated by the agitating process from the nozzles 44 (S8).

Next, the CPU 101 determines whether the number of times of repeating the agitating process and the discharging process has reached N times (S9). When it is determined that the number of times has not reached N times (S9: NO), the CPU 101 returns to the process in S7. On the other hand, when it is determined that the number of times has reached N times (S9: YES), the CPU 101 performs the air discharging process of controlling the cap unit 9 and the suction pump 11 to perform suction purge, thereby forcefully discharging air in the in-head channel 80 from the nozzles 44 (S10). After that, the CPU 101 switches the introduction flag stored in the nonvolatile memory (not shown) from OFF to ON (S11), and ends the process.

On the other hand, when it is determined in S4 that ink has been introduced in the in-head channel 80 of the head 5 (S5: YES), the CPU 101 performs air discharge purge and suction purge in this sequence (S12). Due to this air discharge purge and suction purge, while reducing air in the in-head channel 80, foreign matters, air bubbles, high-viscosity ink due to drying, and so on in the head 5 are discharged from the nozzles 44, and the ejection characteristics of the nozzles 44 are recovered. The operation of the printer 1 has been described.

As described above, according to the present embodiment, in the replacing process, preservation liquid in the in-head channel 80 is discharged after being agitated with ink. Hence, it is possible to discharge, to outside the in-head channel 80, preservation liquid at a channel portion where it is difficult to discharge liquid only by suction purge or flushing. As a result, preservation liquid remaining in the in-head channel 80 can be reduced. Further, in the present embodiment, because preservation liquid can be discharged efficiently in the replacing process, the amount of ink consumed in the replacing process can be reduced. As a result, it is also possible to increase the number of sheets of paper P that can be recorded by the ink cartridge 42 mounted on the printer 1. Further, in the replacing process, because a set of the agitating process and the discharging process is performed repeatedly a plurality of times, preservation liquid in the in-head channel 80 can be reduced reliably.

While the disclosure has been described in detail with reference to the above aspects thereof, it would be apparent to those skilled in the art that various changes and modifications may be made therein without departing from the scope of the claims.

For example, in the above-described embodiment, the discharging process is performed by flushing. However, the discharging process may be performed by suction purge. In this case, the control device 100 controls suction purge in the discharging process and the air discharging process, such that suction purge in the discharging process is different from suction purge in the air discharging process. Specifically, as described above, in the discharging process, because air in the in-head channel 80 need not be discharged, the suction power of the suction pump 11 is set to be low. This suppresses liquid in the in-head channel 80 from being discharged excessively in the discharging process. On the other hand, in the air discharging process, the suction power of the suction pump 11 is set to be higher than in the discharging process. This enables air in the in-head channel 80 can be discharged reliably.

In the above-described embodiment, in the introducing process, the control device 100 controls the suction pump 11 such that at least part of air in the entire ink channel 85 stays at the connection corner portion 90 between the main channel 70 and the linking channel 75. The channel portion at which air stays is not limited to the connection corner portion 90. For example, in the introducing process, the control device 100 may control the suction pump 11 such that air stays at the damper chamber 71 where liquid tends to stagnate.

Further, the control by the control device 100 for keeping air at a particular channel portion in the introducing process is not essential. In this case, air is not kept at the particular channel portion of the in-head channel 80 in the agitating process, and there is a possibility that agitation in the in-head channel 80 is not facilitated. Hence, it is necessary to increase the number of times of repeating the agitating process and the discharging process or to increase the discharge amount of liquid discharged to outside the in-head channel 80 in each discharging process. In this case, if air in the in-head channel 80 is reduced to a degree that the air does not cause ejection malfunction due to air discharge purge in the introducing process, the air discharging process need not be performed in the replacing process. Further, the air discharging process may be performed by the above-described air discharge purge of discharging air in the supply channel 62 from the discharge portions 23 through the air discharge channels 74. In this case, compared with a case where air in the supply channel 62 is discharged from the nozzles 44 by suction purge, air can be discharged to outside the supply channel 62 by lower suction power.

In the above-described embodiment, in the replacing process, the control device 100 repeatedly performs a set of the agitating process and the discharging process a plurality of times. However, the control device 100 may perform a set of the agitating process and the discharging process only once, without repeating the set of the processes.

Figure 9A:
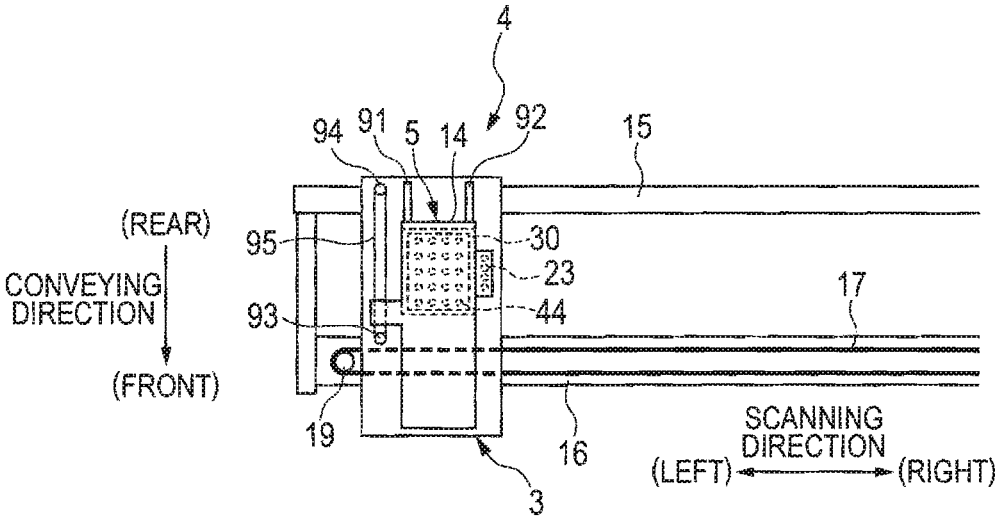
FIGS. 9A and 9B are plan views for illustrating a moving mechanism.
Figure 9B:
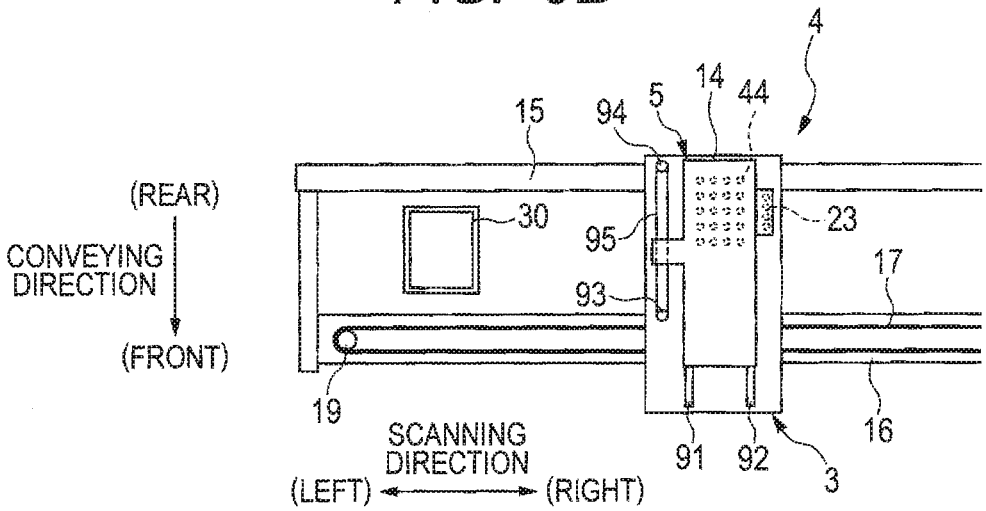
Figure 10:
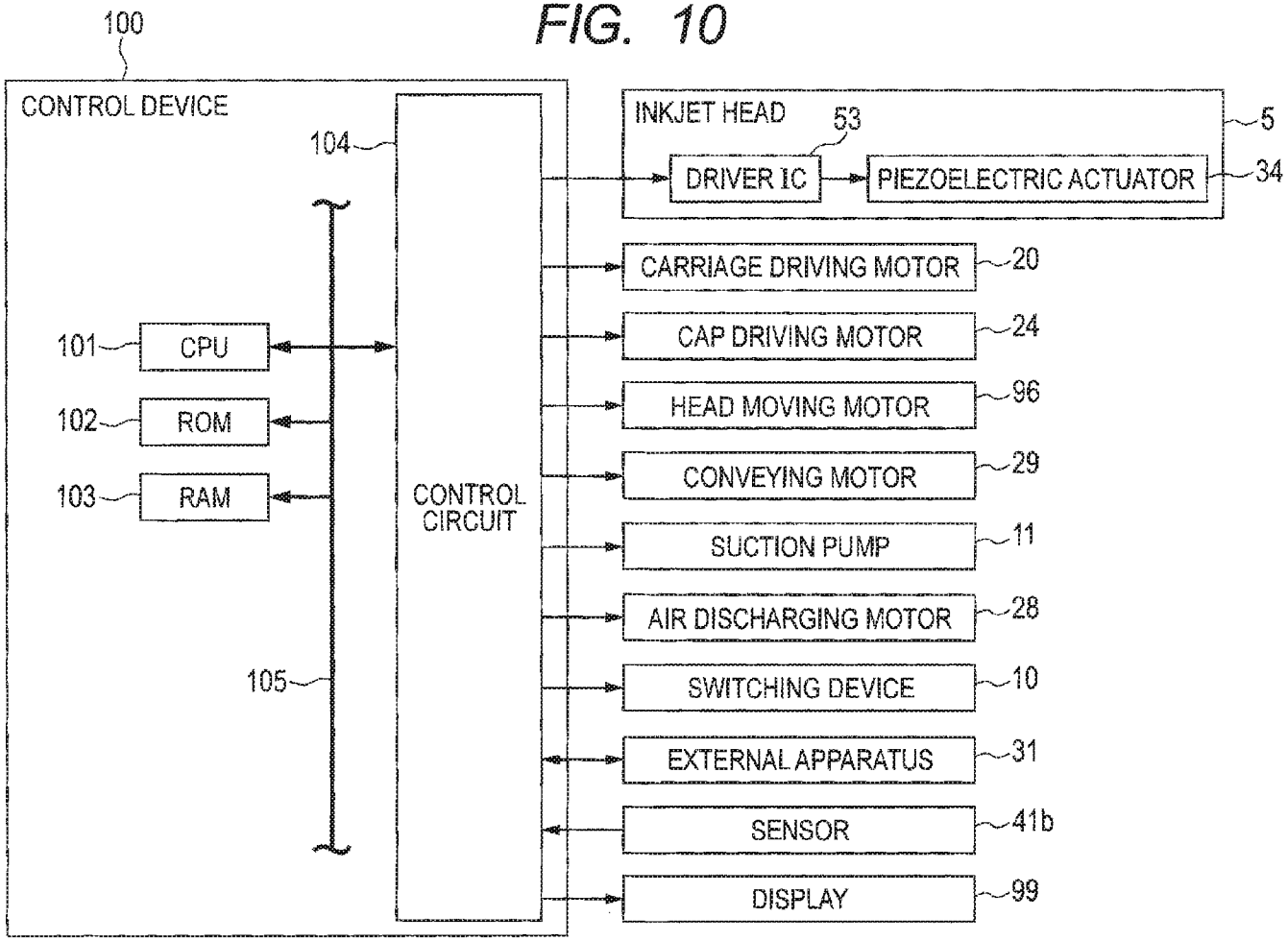
FIG. 10 is a block diagram schematically showing the electrical configuration of an inkjet printer according to a modification.

As shown in FIGS. 9A and 9B, a moving mechanism 4 for moving the head 5 in a direction different from the scanning direction may be provided on the carriage 3, in addition to the head 5. The moving mechanism 4 includes two guide rails 91, 92, two pulleys 93, 94, a drive belt 95, and a head moving motor 96 (see FIG. 10). The two guide rails 91, 92 are provided on the carriage 3, and each extends in the front-rear direction. The head 5 is detachably mounted on the two guide rails 91, 92 and is configured to move in the front-rear direction along the two guide rails 91, 92.

The two pulleys 93, 94 are arranged on the carriage 3 spaced away from each other in the front-rear direction. The pulley 93 is linked to the head moving motor 96. The drive belt 95 is an endless belt looped around the two pulleys 93, 94. When the pulley 93 is driven to rotate by the head moving motor 96, the drive belt 95 moves and accordingly the head 5 moves reciprocatingly in the front-rear direction. As described above, in this modification, the head 5 moves reciprocatingly in the scanning direction together with the carriage 3 by driving of the carriage drive motor 20, and moves reciprocatingly in the front-rear direction by driving of the head moving motor 96.

As shown in FIGS. 9A and 9B, in the agitating process, when the head 5 moves reciprocatingly in the scanning direction, the control device 100 controls the moving mechanism 4 to move the head 5 in the front-rear direction different from the scanning direction. The head 5 may be moved in the front-rear direction when the head 5 moves in the scanning direction, or may be moved in the front-rear direction immediately after the head 5 has moved in the scanning direction. That is, it is preferable that the head 5 be moved in the front-rear direction when liquid in the in-head channel 80 is moving due to the movement of the head 5 in the scanning direction. By moving the head 5 not only in the scanning direction but also in the front-rear direction in this way, the agitation efficiency of liquid in the in-head channel 80 can be further improved. The moving direction of the head 5 by the moving mechanism 4 is not limited to the front-rear direction, and may be any direction different from the left-right direction (the scanning direction).

In the above-described embodiment, the head 5 is moved to agitate liquid in the in-head channel 80. However, the method of agitating liquid is not limited to this. For example, agitation blades may be arranged in the in-head channel 80 and be driven to rotate by a motor, so that liquid flow is generated in the in-head channel 80 so as to agitate liquid.

The flushing receiver 30 is not essential, and liquid discharged from the nozzles 44 at the time of flushing may be received by the nozzle cap 25. Further, preservation liquid need not be filled in the entire channel of the in-head channel 80 at the time of shipment. For example, preservation liquid need not be filled in the damper chamber 71 and the channel at the ink cartridge 42 side of the damper chamber 71.

The air discharge channels 74 for performing air discharge purge are not essential. However, if the air discharge channels 74 are omitted, in the replacing process, all the air in the damper chamber 71 and so on has to be discharged only by suction purge from the nozzles 44 at the end of the in-head channel 80.

In the above-described embodiment, ink is introduced into the in-head channel 80 of the head 5 as ejection liquid. However, the ejection liquid is not limited to ink. For example, the ejection liquid may be process liquid for improving quality of images recorded on paper P. The process liquid includes, for example, process liquid for agglutinating or precipitating ingredients in ink.

In the above-described embodiment, ink is supplied to the entire ink channel 85 from the ink cartridge 42 detachably mounted on the cartridge mount portion 41. However, a tank fixed to the printer 1 may be connected to the entire ink channel 85, and ink may be supplied from this tank. When ink in the tank has been consumed, the user inserts a bottle containing ink in a refill hole formed in the tank and refills ink into the tank from the bottle.

The present disclosure can be applied to a so-called on-carriage type printer that a cartridge mount portion to which ink cartridges are attached is mounted on the carriage.

Further, in the above-described embodiment, the ink cartridge is used as the tank that is the supply source of ink. However, the tank is not limited to this. For example, the tank may be an ink-containing pouch made of flexible resin. This ink-containing pouch has a cap to which the ink supply tube 22 can be connected and, when the ink supply tube 22 is connected to the cap, ink in the ink-containing pouch can flow into the ink supply tube 22. Here, when the ink supply tube 22 is connected to the cap, air enters the ink supply tube 22. Hence, in the introducing process in the replacing process, the control device 100 performs control such that this air stays at the connection corner portion 90 and so on, thereby improving the agitation efficiency of liquid in the agitating process.

The present disclosure can be applied to a so-called line-type inkjet printer in which an inkjet head is fixed and an image is recorded on paper that is conveyed by a conveying mechanism. Further, in the above-described embodiment, the present disclosure is applied to an inkjet printer that records images and so on by ejecting ink onto paper. However, the present disclosure can be applied to liquid ejecting apparatuses that are used in various purposes other than forming images. For example, the present disclosure can be applied to a liquid ejecting apparatus that ejects conductive liquid on a substrate to form a conductive pattern on the surface of the substrate.

What is claimed is:

1. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger such that air stays at a particular channel portion in the liquid channel, the particular channel portion being a portion where the second liquid exists before starting the introducing process;

wherein the tank comprises:

a storage chamber configured to store the first liquid; and a supplying portion configured to supply the first liquid from the storage chamber to outside the tank;

wherein the liquid ejecting apparatus further comprises a tank mount portion configured so that the tank is detachably mounted thereon, the tank mount portion having a connection part connected to the liquid channel, the connection part being configured to connect to the supplying portion of the tank when the tank is mounted so as to allow the first liquid to flow therethrough; and wherein the introducing process comprises controlling the discharger such that a total discharge amount of liquid discharged from inside the liquid channel to outside the liquid channel is an amount corresponding to a volume between a connection position and the particular channel portion, thereby moving at least part of entering air to the particular channel portion, the connection position being a connection position between the liquid channel and the connection part, the entering air being air that enters the liquid channel when the supplying portion of the tank is connected to the connection part of the tank mount portion.

2. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger such that air stays at a particular channel portion in the liquid channel, the particular channel portion being a portion where the second liquid exists before starting the introducing process;

wherein the head unit comprises:

a head main body having the nozzles and configured to eject the first liquid from the nozzles; and a liquid supply member configured to supply the head main body with the first liquid;

wherein the liquid channel comprises:

a head channel formed in the head main body, the head channel having a supply port through which the first liquid is supplied from the liquid supply member; and a supply channel formed in the liquid supply member and allowing fluid communication between the supply port and the tank;

wherein the supply channel comprises:

a first channel connected to the supply port of the head channel and extending upward from the supply port, the first channel having a first end and a second end opposite the first end, the first end being connected to the supply port;

a second channel connected to the second end of the first channel, the second channel extending in a direction intersecting an extending direction of the first channel; and a connection corner portion being a corner portion connecting the first channel and the second channel, the connection corner portion being located at an uppermost position in the first channel and the second channel; and wherein the introducing process comprises controlling the discharger such that air in the liquid channel stays at the connection corner portion, the particular channel portion being the connection corner portion.

3. The liquid ejecting apparatus according to claim 2, wherein the first channel extends in a vertical direction, and the second channel extends in a horizontal direction; and wherein the connection corner portion is located at same height as an entirety of the second channel.

4. The liquid ejecting apparatus according to claim 2, wherein the first channel comprises an upper channel having a first channel cross-sectional area, and a lower channel having a second channel cross-sectional area smaller than the first channel cross-sectional area.

5. The liquid ejecting apparatus according to claim 4, wherein the discharging process comprises controlling the discharger to discharge the liquid of an amount corresponding to volume of the lower channel.

6. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger such that air stays at a particular channel portion in the liquid channel, the particular channel portion being a portion where the second liquid exists before starting the introducing process;

wherein the head unit comprises:

a head main body having the nozzles and configured to eject the first liquid from the nozzles; and a liquid supply member configured to supply the head main body with the first liquid;

wherein the liquid channel comprises:

a head channel formed in the head main body, the head channel having a supply port through which the first liquid is supplied from the liquid supply member; and a supply channel formed in the liquid supply member and allowing fluid communication between the supply port and the tank, the supply channel comprising a damper chamber configured to suppress pressure fluctuation of liquid supplied to the head main body; and wherein the introducing process comprises controlling the discharger such that air in the liquid channel stays at the damper chamber, the particular channel portion being the damper chamber.

7. The liquid ejecting apparatus according to claim 1, further comprising:

an air discharge channel connected to the liquid channel and configured to discharge air; and a switcher configured to switch the air discharge channel between an open state and a close state;

wherein the discharger is configured to connect to the air discharge channel in the open state; and wherein the memory further stores instructions, when executed by the processor, causing the processor to, after the discharging process, perform an air discharging process of controlling the discharger and the switcher to discharge air in the liquid channel through the air discharge channel.

8. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger such that air stays at a particular channel portion in the liquid channel, the particular channel portion being a portion where the second liquid exists before starting the introducing process;

wherein the discharger comprises a purge unit having a cap configured to be attached to the head unit so as to cover the nozzles and a suction pump connected to the cap, the purge unit being configured to drive the suction pump to perform suction in the cap in a state where the cap is attached to the head unit, thereby discharging liquid and air in the liquid channel through the nozzles;

wherein the discharging process comprises controlling the purge unit to perform purge of discharging liquid in the liquid channel through the nozzles;

wherein the memory further stores instructions, when executed by the processor, causing the processor to, after the discharging process, perform an air discharging process of controlling the purge unit to perform purge of discharging air in the liquid channel through the nozzles; and wherein the purge of the air discharging process comprises controlling the purge unit such that suction power of the suction pump is higher than suction power of the suction pump in the purge of the discharging process.

9. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger such that air stays at a particular channel portion in the liquid channel, the particular channel portion being a portion where the second liquid exists before starting the introducing process;

wherein the head unit comprises, as the discharger, an energy generator configured to apply ejection energy to liquid in the liquid channel;

wherein the discharger comprises a purge unit having a cap configured to be attached to the head unit so as to cover the nozzles and a suction pump connected to the cap, the purge unit being configured to drive the suction pump to perform suction in the cap in a state where the cap is attached to the head unit, thereby discharging liquid and air in the liquid channel through the nozzles;

wherein the discharging process comprises controlling the energy generator to perform flushing of ejecting liquid in the liquid channel through the nozzles; and wherein the memory further stores instructions, when executed by the processor, causing the processor to, after the discharging process, perform an air discharging process of controlling the purge unit to perform purge of discharging air in the liquid channel through the nozzles.

10. The liquid ejecting apparatus according to claim 7, wherein the agitating process and the discharging process comprise repeating a set of the agitating process and the discharging process a plurality of times.

11. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

a carriage on which the head unit is mounted, the carriage being configured to move reciprocatingly in a scanning direction together with the head unit; and a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the carriage to move reciprocatingly in the scanning direction so as to agitate liquid in the liquid channel; and a discharging process of, after the agitating process, controlling the discharger to discharge the liquid in the liquid channel agitated by the carriage to outside the liquid channel.

12. The liquid ejecting apparatus according to claim 11, further comprising a moving mechanism configured to move the head unit in a direction different from the scanning direction; and wherein the agitating process comprises, when the head unit moves reciprocatingly in the scanning direction, controlling the moving mechanism to move the head unit in the direction different from the scanning direction.

13. The liquid ejecting apparatus according to claim 11, further comprising a liquid receiver disposed at a part of a moving range of the head unit in the scanning direction, the liquid receiver being configured to receive liquid discharged through the nozzles;

wherein the agitating process and the discharging process comprise repeating a set of the agitating process and the discharging process a plurality of times;

wherein each of the plurality of times of the agitating process comprises controlling the carriage to move the head unit from an origin position facing the liquid receiver one way in the scanning direction and thereafter to move the head unit back to the origin position; and wherein each of the plurality of times of the discharging process comprises controlling the discharger to discharge liquid in the liquid channel toward the liquid receiver through the nozzles.

14. The liquid ejecting apparatus according to claim 11, wherein the agitating process comprises performing a first accelerating operation of accelerating the carriage from an origin position to reach a particular velocity and, immediately after that, without performing a constant-velocity operation, performing a first decelerating operation of decelerating the carriage to stop at a turn position, and performing a second accelerating operation of accelerating the carriage from the turn position in an opposite direction to reach the particular velocity and, immediately after that, without performing a constant-velocity operation, performing a second decelerating operation of decelerating the carriage and returning the carriage to the origin position.

15. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the head unit comprises, as the discharger, an energy generator configured to apply ejection energy to liquid in the liquid channel;

wherein the agitating process and the discharging process comprise repeating a set of the agitating process and the discharging process a plurality of times; and wherein each of the plurality of times of the discharging process comprises controlling the energy generator to perform flushing of ejecting liquid in the liquid channel through the nozzles.

16. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, wherein the introducing process comprises controlling the discharger to discharge at least part of the second liquid in the liquid channel to outside the liquid channel.

17. A liquid ejecting apparatus comprising:

a head unit having nozzles configured to eject first liquid and having a liquid channel in fluid communication with the nozzles, the liquid channel being configured to supply the nozzles with the first liquid stored in a tank;

a discharger configured to discharge liquid in the liquid channel to outside the liquid channel, the liquid being at least one of the first liquid and second liquid different from the first liquid;

an agitator configured to agitate the liquid in the liquid channel;

a processor; and a memory storing instructions, the instructions, when executed by the processor, causing the processor to perform:

an introducing process of, when the second liquid exists in the liquid channel, controlling the discharger to discharge the second liquid to outside the liquid channel and to introduce the first liquid from the tank into the liquid channel;

an agitating process of, after the introducing process, controlling the agitator to agitate the liquid in the liquid channel; and a discharging process of, after the agitating process, controlling the discharger to discharge the liquid in the liquid channel agitated by the agitator to outside the liquid channel, further comprising a nonvolatile memory configured to store an introduction flag indicative of whether the introducing process has been performed after shipment of the liquid ejecting apparatus, wherein the memory further stores instructions, when executed by the processor, causing the processor to:

read the introduction flag; and when the introduction flag indicates that no introducing process has been performed after shipment, determine that the second liquid exists in the liquid channel and perform the introducing process.

* * * * *